US009084038B2

(12) United States Patent
Siotis et al.

(10) Patent No.: US 9,084,038 B2
(45) Date of Patent: Jul. 14, 2015

(54) METHOD OF CONTROLLING AUDIO RECORDING AND ELECTRONIC DEVICE

(75) Inventors: Georg Siotis, Lund (SE); Magnus Abrahamsson, Loddekopinge (SE); Martin Nystrom, Horja (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 821 days.

(21) Appl. No.: 13/386,929

(22) PCT Filed: Dec. 22, 2010

(86) PCT No.: PCT/EP2010/007896

§ 371 (c)(1),
(2), (4) Date: Jan. 25, 2012

(87) PCT Pub. No.: WO2012/083989

PCT Pub. Date: Jun. 28, 2012

(65) Prior Publication Data

US 2012/0163625 A1 Jun. 28, 2012

(51) Int. Cl.

| | |
|---|---|
| ***H04R 3/00*** | (2006.01) |
| *H04R 1/40* | (2006.01) |
| *H04S 7/00* | (2006.01) |

(52) U.S. Cl.

CPC ..... *H04R 3/005* (2013.01); *H04R 1/406* (2013.01); *H04R 2499/11* (2013.01); *H04S 7/304* (2013.01); *H04S 2400/15* (2013.01)

(58) Field of Classification Search

USPC ..... 381/56, 92, 122; 348/14.02, E7.078, 348/E7.081

See application file for complete search history.

(56) References Cited

U.S. PATENT DOCUMENTS

| | | | |
|---|---|---|---|
| 5,748,992 | A | 5/1998 | Tsukahara et al. |
| 5,940,118 | A | 8/1999 | Van Schyndel |
| 2008/0136916 | A1 | 6/2008 | Wolff |
| 2010/0026780 | A1 | 2/2010 | Tico et al. |

OTHER PUBLICATIONS

International Search Report, corresponding to PCT/EP2010/007896, mailed Nov. 23, 2011.

Written Opinion of the International Searching Authority, corresponding to PCT/EP2010/007896, mailed Nov. 23, 2011.

*Primary Examiner* — Vivian Chin
*Assistant Examiner* — Friedrich W Fahnert
(74) *Attorney, Agent, or Firm* — Renner, Otto, Boisselle & Sklar, LLP

(57) ABSTRACT

A method of controlling audio recording using an electronic device and an electronic device are described. The electronic device comprises a microphone arrangement having a directivity pattern. A target direction relative to the electronic device is automatically determined in response to sensor data representing at least a portion of an area surrounding the electronic device. The microphone arrangement is automatically controlled in response to the determined target direction to adjust an angular orientation of the directivity pattern relative to the electronic device.

22 Claims, 7 Drawing Sheets

METHOD OF CONTROLLING AUDIO RECORDING AND ELECTRONIC DEVICE

The invention relates to a method of controlling audio recording using an electronic device and to an electronic device. The invention relates in particular to such a method and device for use with a directional microphone which has a directivity pattern.

BACKGROUND OF THE INVENTION

A wide variety of electronic devices nowadays is provided with equipment for recording audio data. Examples for such electronic devices include portable electronic devices which are intended to simultaneously record audio and video data. Examples include modern portable communication devices or personal digital assistants. There is an increasing desire to configure such devices so as to allow a user to record audio data, possibly in combination with video data, originating from an object located at a distance from the electronic device.

Background noise may be a problem in many application scenarios. Such problems may be particularly difficult to address in cases where the electronic device is not a dedicated device for audio recording purposes, but has additional functionalities. In such cases, limited construction space as well as cost issues may impose constraints on which technologies may be implemented in the electronic device to address background noise problems.

Electronically controllable directional microphones provide one way to address some of the problems associated with background noise. For illustration, a directional microphone may be integrated into an electronic device which also has an optical system for recording video data. The directional microphone may be configured such that it has high sensitivity along the optical axis of the optical system. The directional microphone may also be adjusted so as to account for varying optical zooms, which may be indicative of varying distances of the sound source from the electronic device. In such an electronic device, the user will generally have to align the optical axis of the optical system with the sound source to obtain good signal to noise ratios. This may be inconvenient in some situations, and even close to impossible in other situations, such as when there are several sound sources in one image frame.

It is generally also possible to detect the direction in which sound sources are located based on the sound signals received at plural microphones of a microphone array. Based on time differences in arrival times of pronounced sound signals, the direction of at least the dominant sound source may be estimated. Relying on the output signals of a microphone array for controlling the audio recording may be undesirable for various reasons. For illustration, if the dominant sound source is different from the one the user is actually interested in, deriving a direction estimate based on the sound signals received at plural microphones may not allow the quality of sound recording to be enhanced for the desired sound source.

SUMMARY OF THE INVENTION

Accordingly, there is a continued need in the art for a method of controlling audio recording using an electronic device and for an electronic device which address some of the above shortcomings. In particular, there is a continued need in the art for a method and an electronic device which does not require the user to dedicatedly align a particular axis of the electronic device, such as the optical axis of an optical system, with the direction of a sound source. There is also a continued need in the art for a method and an electronic device which is not required to rely on the output signals of a microphone to determine the direction in which a sound source is located.

According to an aspect, a method of controlling audio recording using an electronic device is provided. The electronic device comprises a microphone arrangement which forms a directional microphone having a directivity pattern. In the method, sensor data are captured using a sensor different from the microphone arrangement. The captured sensor data represent at least a portion of an area surrounding the electronic device. A target direction relative to the electronic device is automatically determined in response to the captured sensor data. The microphone arrangement is automatically controlled in response to the determined target direction to adjust an angular orientation of the directivity pattern relative to the electronic device.

In the method, the angular orientation of the directivity pattern is controlled relative to the electronic device. Thereby, sound coming from a sound source located at different orientations relative to the electronic device can be recorded with improved signal to noise (S/N) ratios, without requiring the orientation of the electronic device to be re-adjusted. With the target direction being determined responsive to sensor data captured using a sensor different from the microphone arrangement, good S/N can be attained even if the sound source for which the audio recording is to be performed has a sound level smaller than that of a background sound source. With the target direction being determined automatically in response to the sensor data, and with the microphone arrangement being controlled automatically, the method may be performed without requiring a dedicated user confirmation. This makes the audio recording more convenient to the user.

The electronic device may be a portable electronic device. The electronic device may be a device which is not a dedicated audio-recording device, but which includes additional functionalities. The electronic device may be a portable wireless communication device. The electronic device may be configured to perform combined audio and video recording.

The directivity pattern of the microphone arrangement may define a sound capturing lobe. A direction of a center line of the sound capturing lobe relative to the electronic device may be adjusted in response to the determined target direction. The direction of the center line may be adjusted such that it coincides with the target direction. The center line of the sound capturing lobe may be defined to be the direction in which the microphone arrangement has highest sensitivity.

The direction of the center line of the sound capturing lobe may be selectively adjusted in two orthogonal directions in response to the determined target direction. It may not always be required to adjust the center line of the sound capturing lobe in more than one direction. Still, the controlling may be implemented such that the center line of the sound capturing lobe may selectively be adjusted in a first plane relative to the electronic device, or in a second plane orthogonal to the first plane, or in both the first plane and the second plane. For illustration, the microphone arrangement may be configured such that the direction of the center line of the sound capturing lobe may be adjusted both horizontally and vertically.

The microphone arrangement may include at least four microphones arranged in an array. The four microphones may be arranged such that at least one of the microphones is offset from a straight line passing through a pair of other microphones of the array.

The microphone arrangement may be controlled such that an aperture angle of the sound capturing lobe is adjusted. The aperture angle may be adjusted based on whether sound coming from one sound source or sound coming from plural sound sources is to be recorded. If the electronic device includes components for image recoding, the aperture angle may also be controlled based on a visual zoom setting, which may for example include information on the position of a zoom mechanism.

The sound capturing lobe of the directivity pattern may be disposed on a first side relative to a plane defined by the microphone arrangement, and the sensor data used as a control input may represent a portion of the area surrounding the electronic device which is disposed on a second side opposite the first side. In other words, the sensor data defining a control input for the audio recording may be captured on one side relative to the plane defined by the microphone arrangement, while the microphone arrangement has highest sensitivity on the other side of the plane defined by the microphone arrangement. This allows a user to perform audio recording by holding the electronic device so that it is interposed between the sound source(s) and the user, while the captured sensor data may be representative of the user positioned behind the electronic device (as seen from the sound source(s)).

The portion of the area surrounding the electronic device, which is represented by the captured sensor data, may be spaced from the electronic device.

The sensor may monitor a portion of a user's body which is spaced from the electronic device to capture the sensor data. This allows the angular characteristics of the microphone arrangement to be controlled by the user's body, without requiring the user to perform specific touch-based input functions on the electronic device. Various configurations of such sensors may be implemented. The sensor may be a sensor integrated into a headset worn by the user. The sensor may also be a video sensor integrated in the electronic device.

The sensor data may be processed to identify a gesture of the user. The angular orientation of the directivity pattern may be adjusted in response to the identified gesture. This allows gesture-based control of the angular characteristics of the microphone arrangement. The gesture may be a very simple one, such as the user pointing towards a sound source with his arm or directing his facial direction towards the sound source by turning his head.

The sensor data may be processed to identify an eye gaze direction of the use. The angular orientation of the directivity pattern may be adjusted in response to the identified eye gaze direction. This allows eye gaze-based control of the angular characteristics of the microphone arrangement.

The sensor may comprise sensor components integrated into a headset worn by the user. This may allow sensor data indicative of a facial direction and/or eye gaze direction to be determined with high accuracy. Further, such an implementation of the sensor allows the angular characteristics of the microphone arrangement to be controlled in a manner which is not limited by a field of view of an image sensor.

The sensor may comprise an electronic image sensor. The electronic image sensor may have a field of view overlapping with that of the microphone arrangement. The image data may be processed to recognize at least one human face in the image data.

If plural human faces are identified in the image when performing face recognition, different procedures may be invoked to determine the target direction. In an implementation, the target direction may be set so as to correspond to one of plural identified faces. Selecting one of the faces may be done automatically. In an implementation, plural portions of the image data representing plural human faces may be determined. The plural portions representing plural human faces may be monitored in successive image frames of a video sequence to determine a person who is speaking, for example based on lip movement. The target direction may be set so as to correspond to the direction of the person who is speaking relative to the electronic device. An aperture angle of a sound capturing lobe may be set based on the size of the portion representing the face of the person who is speaking and, optionally, based on visual zoom settings used when acquiring the image data.

In an implementation, the target direction may be set so that the plural human faces are all located within the beam capturing lobe. In this case, the target direction may be set so as to correspond to neither individual face, but may rather be selected so as to point towards an intermediate position between the plural identified faces. The target direction may be set based on the image coordinates of the plural portions of the image data which respectively represent a human face. The aperture angle of a sound capturing lobe may be set so as to ensure that the plural human faces are all located within the sound capturing lobe. The aperture angle(s) may be set based on visual zoom settings used when acquiring the image data.

In the method of any one aspect or embodiment, the determined target direction may be provided to a beam forming subsystem of the microphone arrangement. The microphone arrangement may include a sound processor programmed to implement audio beam forming. The determined target direction and, if applicable, aperture angle(s) of a sound capturing lobe may be supplied to the sound processor. The sound processor adjusts the sound processing in accordance thereto, so as to align the sound capturing lobe with the desired target direction.

The method of any one aspect or embodiment may include monitoring a lock trigger event. If the lock trigger event is detected, the direction of the sound capturing lobe may remain directed, in a world frame of reference, towards the direction as determined based on the captured sensor data. After the lock trigger event has been detected, the control of the angular orientation of the directivity pattern may be decoupled from the captured sensor data until a release event is detected.

The lock trigger event and release event may take various forms. For illustration, the lock trigger event may be that a user's gesture or eye gaze remains directed towards a given direction for a pre-determined time and with a predetermined accuracy. For illustration, if the user's gesture or eye gaze is directed in one direction, within a predetermined accuracy, for a predetermined time, this direction may become the target direction until a release event is detected. The release event may then be that the user's gesture or eye gaze is directed in another direction, within a predetermined accuracy, for the predetermined time. Thereby, a hysteresis is introduced in the control of the angular orientation of the sound capturing lobe, with the sound capturing lobe becoming decoupled from the sensor data in a lock condition and being readjusted only after a release condition has been met. Similarly, if the angular orientation of the directivity pattern is slaved to the results of face recognition of image data, the direction associated with a face that has been determined to belong to the active sound source may remain the target direction even if another face shows lip movement for a short time. Release may occur by the other face showing lip movement for more than the predetermined time. In another implementation, the trigger event and/or release event may be a dedicated user command, in the form of the user actuating a button, issuing a voice command, a gesture command, or similar.

According to another aspect, an electronic device is provided. The electronic device comprises a microphone arrangement having a directivity pattern and a controller coupled to the microphone arrangement. The controller has an input to receive sensor data from a sensor different from the microphone arrangement, the sensor data representing at least a portion of an area surrounding the electronic device. The controller may be configured to automatically determine a target direction relative to the electronic device in response to the captured sensor data. The controller may be configured to automatically control the microphone arrangement in response to the determined target direction to adjust an angular orientation of the directivity pattern relative to the electronic device.

The microphone arrangement may comprise an array having a plurality of microphones and a sound processor coupled to receive output signals from the plurality of microphones. The controller may be coupled to the sound processor to automatically adjust, in response to the determined target direction, a direction of a sound capturing lobe of the microphone arrangement relative to the electronic device. The processor may set audio beam forming settings of the sound processor.

The controller may be configured to control the microphone arrangement to selectively adjust an orientation of the sound capturing lobe in two orthogonal directions in response to the identified target direction. The microphone arrangement may include four microphones, and the controller may be configured to adjust the processing of the output signals from the four microphones so that the direction of a sound capturing lobe is adjustable in the two directions. For illustration, the electronic device may be configured such that the direction of the sound capturing lobe can be adjusted both horizontally and vertically.

The controller may be configured to process the sensor data to identify a user's gesture and to determine the target direction based on the gesture. The gesture may be a user's facial direction or a user's arm direction. Alternatively or additionally, the controller may be configured to process the sensor data to identify a user's eye gaze direction. Thereby, the direction of a sound capturing lobe may be tied to the focus of the user's attention.

The sensor data may comprise image data. The controller may be configured to process the image data to identify a portion of the image data representing a human face and to automatically determine the target direction relative to the electronic device based on the portion of the image data representing the human face.

The electronic device may comprise an image sensor having an optical axis. The controller may be configured to automatically control the microphone arrangement to adjust an angular orientation of the directivity pattern relative to the optical axis. This allows the focus of the audio recording to be controlled independently of the focus of a video recording. The image sensor may capture and provide at least a portion of the sensor data to the controller.

The electronic device may be configured as a portable electronic communication device. For illustration, the electronic device may be a cellular telephone, a personal digital assistant, a mobile computing device having audio recording features, or any similar device, without being limited thereto.

The electronic device may comprise a sensor configured to capture the sensor data. The sensor, or at least components of the sensor, may also be provided externally of the electronic device. For illustration, components of the sensor may be integrated into a peripheral device, such as a headset, which is in communication with, but physically separate from the electronic device.

An electronic system according to an aspect includes the electronic device of any one aspect or embodiment, and sensor components separate from the electronic device. The sensor components may be integrated into a headset.

It is to be understood that the features mentioned above and features yet to be explained below can be used not only in the respective combinations indicated, but also in other combinations or in isolation, without departing from the scope of the present invention. Features of the above-mentioned aspects and embodiments may be combined in other embodiments.

BRIEF DESCRIPTION OF THE DRAWINGS

The foregoing and additional features and advantages of the invention will become apparent from the following detailed description when read in conjunction with the accompanying drawings, in which like reference numerals refer to like elements.

DETAILED DESCRIPTION OF EMBODIMENTS OF THE INVENTION

Figure 1:
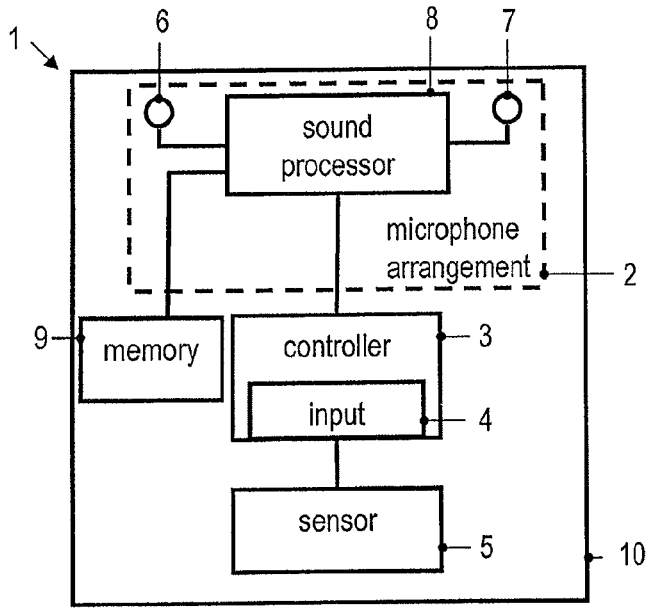
FIG. 1 is a schematic representation of an electronic device according to an embodiment.

In the following, embodiments of the invention will be described in detail with reference to the accompanying drawings. It is to be understood that the following description of embodiments is not to be taken in a limiting sense. The scope of the invention is not intended to be limited by the embodiments described hereinafter or by the drawings, which are taken to be illustrative only.

The drawings are to be regarded as being schematic representations, and elements illustrated in the drawings are not necessarily shown to scale. Rather, the various elements are represented such that their function and general purpose become apparent to a person skilled in the art. Any connection or coupling between functional blocks, devices, components or other physical or functional units shown in the drawings or described herein may also be implemented by an indirect connection or coupling. Functional blocks may be implemented in hardware, firmware, software or a combination thereof.

The features of the various exemplary embodiments described herein may be combined with each other, unless specifically noted otherwise.

Electronic devices for audio recording and methods of controlling the audio recording will be described. The electronic device has a microphone arrangement which is configured as a directional microphone. A directional microphone is an acoustic-to-electric transducer or sensor which has a spatially varying sensitivity. The spatially varying sensitivity may also be referred to as a "directivity pattern". Angular ranges corresponding to high sensitivity may also be referred to as a "lobe" or "sound capturing lobe" of the microphone arrangement. A center of such a sound capturing lobe may be regarded to correspond to the direction in which the sensitivity has a local maximum.

The microphone arrangement is controllable such that the directivity pattern can be re-oriented relative to the electronic device. Various techniques are known in the art for adjusting the directivity pattern of a microphone arrangement. For illustration, audio beam forming may be used in which the output signals of plural microphones of the microphone arrangement are subject to filtering and/or the introduction of time delays.

FIG. 1 is a schematic block diagram representation of a portable electronic device 1 according to an embodiment. The device 1 includes a microphone arrangement 2 and a controller 3 coupled to the microphone arrangement. The microphone arrangement 2 forms a directional microphone which has a directivity pattern. The directivity pattern may include one or plural sound capturing lobes. The device 1 further includes a sensor 5 which captures sensor data representing at least a portion of an area surrounding the device 1. The sensor 5 may include an electronic image sensor 5 or other sensor components, as will be described in more detail below. The controller 3 has an input 4 to receive captured sensor data from the sensor 5. The controller 3 processes the captured sensor data to determine a target direction for a sound capturing lobe of the microphone arrangement 2, relative to the device 1. The controller 3 may further determine an aperture angle of the sound capturing lobe based on the captured sensor data. The controller 3 controls the microphone arrangement 2 so as to adjust the direction of the sound capturing lobe relative to a housing 10 of the device 2.

The microphone arrangement 2 includes an array of at least two microphones 6, 7. While two microphones 6, 7 are shown in FIG. 1 for illustration, the device 1 may include a greater number of microphones. For illustration, the microphone arrangement 2 may include four microphones. The four microphones may be arranged at the corner locations of a rectangle. Output terminals of the microphones 6, 7 are coupled to a sound processor 8. The sound processor 8 processes the output signals of the microphones. The sound processor 8 may in particular be configured to perform audio beam forming. The audio beam forming is performed based on parameters which define the orientation of the directivity pattern. The techniques for audio beam forming as such are well known to the skilled person.

The controller 3 controls the sound processor 8 in accordance with the target direction and, if applicable, in accordance with the aperture angle(s) determined by the controller 3 in response to the sensor data. The control functions performed by the controller 3 in processing the sensor data and controlling the directional microphone 2 in response thereto may be performed automatically in the sense that no dedicated user input is required to make a selection or confirmation. In an implementation, the controller 3 may provide the determined target direction and the determined aperture angle (s) to the sound processor 8. The sound processor 8 may then adjust parameters of the sound processing, such as time delays, filtering, attenuation, and similar, in accordance with the received instructions from the controller 3, so as to attain a directivity pattern with a sound capturing lobe pointing towards the target direction and having the indicated aperture angle(s). The directivity pattern of the microphone arrangement 2 may have plural lobes having enhanced sensitivity. In this case, the controller 3 and sound processor 8 may be configured such that the sound capturing lobe which is aligned with the target direction is the main lobe of the microphone arrangement 2.

The controller 3 and microphone arrangement 2 may be configured such that the direction of the sound capturing lobe may be adjusted relative to the housing in at least one plane. However, in any embodiment described herein, the microphone arrangement 2 may also be equipped with more than two microphones. In this case, the controller 3 and microphone arrangement 2 may be configured such that the direction of the sound capturing lobe may be adjusted not only in one, but in two independent directions. For a given orientation of the device 1, the two independent directions may correspond to horizontal and vertical adjustment of the sound capturing lobe.

An output signal of the sound processor 8 is provided to other components of the device 1 for downstream processing. For illustration, an output signal of the sound processor 8 representing the audio data captured with the directional microphone arrangement 2 may be stored in a memory 9, transmitted to another entity, or processed in another way.

The device 1 may include an electronic image sensor which may be comprised by the sensor 5 or may be separate from the sensor 5. For illustration, if the sensor 5 is configured to capture information relating to a user's gestures and/or facial direction, the sensor 5 may be configured as an electronic image sensor. The electronic image sensor 5 may then include an aperture on one side of the housing 10 of the device 1 for capturing images of the user, while the microphones 6, 7 of the microphone arrangement define openings on the opposite side of the housing 10 of the device 1. In this case, the field of view of the sensor 5 and the field of view of the microphone arrangement 2 may be essentially disjoint. Such a configuration may be particularly useful when a user controls audio recording with gestures and/or eye gaze, with the device 1 being positioned in between the user and the sound sources. The device 1 may include another image sensor (not shown in FIG. 1) having a field of view over-lapping with, or even identical to, that of the microphone arrangement 2. Thereby, combined video and audio recording may be performed.

In other implementations, the sensor 5 which captures the sensor data for controlling the angular orientation of a sound capturing lobe may be an image sensor having a field of view overlapping with, or even identical to, that of the microphone arrangement 2. I.e., apertures for the image sensor and for the microphones of the microphone arrangement 2 may be provided on the same side of the housing 10. Using such a configuration, automatic image processing may be applied to images representing potential sound sources. In particular, the controller 3 may be configured to perform face recognition in image data to identify sound sources, and may then control the microphone arrangement 2 based thereon. Thereby, the orientation of the directivity pattern of the microphone arrangement may be automatically adjusted based on visual images of potential sound sources, without requiring any user selection.

While the device 1 includes the sensor 5 capturing the sensor data used as control input, the sensor for capturing the sensor data may also be provided in an external device separate from the device 1. Alternatively or additionally, both the device 1 and an external device may include sensor components which cooperate to capture the sensor data. For illustration, for eye gaze-based control, it may be useful to have sensor components for determining a user's eye gaze direction relative to a headset or relative to glasses worn by the user, with the sensor components being integrated into the headset or glasses. It may further be useful to have additional sensor components for determining the position and orientation of the headset or glasses relative to the device 1. The latter sensor components may be integrated into the headset or glasses, respectively, or into the device 1.

Figure 2:
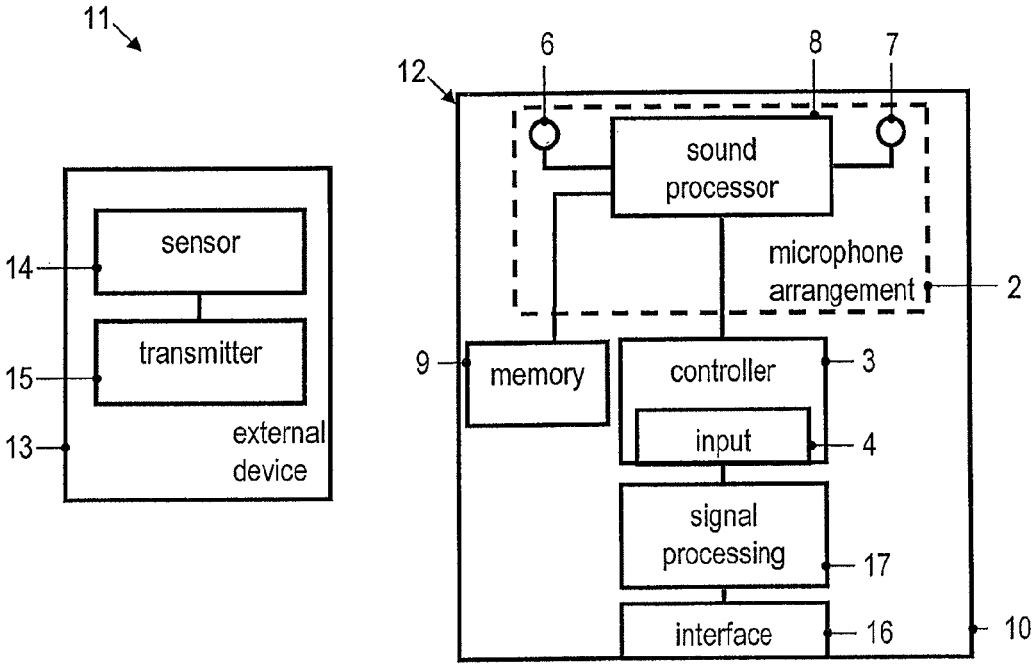
FIG. 2 is a schematic representation of an electronic system comprising an electronic device according to another embodiment.

FIG. 2 is a schematic block diagram representation of a system 11 which includes a portable electronic device 12 according to an embodiment. Elements or features which correspond, with regard to function and/or construction, to elements or features already described with reference to FIG. 1 are designated with the same reference numerals.

The system 11 includes an external device 13. The external device 13 is separate from the device 12. For illustration, the external device 13 may be headset worn by the user. The headset may include at least one of an earphone, microphone and/or a pair of (virtual reality) glasses.

A sensor 14 for capturing sensor data representing at least a portion of the area surrounding the device 12 is provided in the external device 13. The external device 13 includes a transmitter 15 for transmitting the captured sensor data to the device 12. The captured sensor data may have various forms depending on the specific implementation of the sensor 14 and the external device 13. For illustration, if the sensor 14 includes an image sensor for recording a user's eye for determining an eye gaze direction, the sensor data may be image data transmitted to the device 12 for evaluation. Alternatively, the eye gaze direction or eye gaze point may be determined in the external device 13 and may be transmitted to the device 12 as a pair of angle coordinates. If the sensor 14 includes a sensor for sensing a relative orientation and/or distance of the external device 13 from the device 12, the sensor 14 may capture three magnetic field strengths and transmit the same to the device 12 for further processing when magnetic orientation sensing is employed.

The device 12 includes an interface 16 for receiving the data transmitted by the external device 13. The device 12 may include componentry 17 for processing the signals received at the interface 16. The signal processing componentry 17 may have a conventional receiver path configuration operative in accordance with the signal communication protocol between the external device 13 and the device 12.

The controller 3 receives the sensor data transmitted to the device 12 from the signal processing componentry 17. The controller 3 processes the sensor data as explained with reference to FIG. 1, in order to adjust the angular orientation of a sound capturing lobe relative to the device 12.

As already mentioned, the sensor that captures the sensor data may have different configurations. In some implementations, the sensor may read at least one of a user's behavior, a user's body position, a user's hand position, a user's head position, or a user's eye focus. The sensor may read such information based on portions of a user's body which are spaced from the device 12. Such information is indicative of a user's focus of interest. The controller of the electronic device may control the microphone arrangement based on the sensor data. The control may be implemented such that the main lobe of the microphone arrangement is automatically directed towards the focus of interest of the user. When the user's focus of attention shifts, the main lobe of the microphone arrangement follows. By contrast, if the user's focus of attention remains directed in one direction, so does the main lobe of the microphone even if the orientation of the device is altered in space.

Alternatively or additionally, the sensor may capture image data representing an area from which the microphone arrangement can capture sound. As used herein, the term "image data" includes a sequence of image data representing a video sequence. By processing the image data, portions of the image data may be identified which represent a human face or plural human faces. The human face(s) may be arranged offset relative to a center of the image. The controller of the electronic device may automatically control the microphone arrangement based on the image coordinates of the human face(s) in the image data. The control may be implemented such that the main lobe of the microphone arrangement is automatically directed towards the face(s). When the face(s) shift relative to the device, the main lobe of the microphone arrangement follows.

Embodiments will be illustrated in more detail in the context of exemplary scenarios with reference to FIGS. 3-6 and FIGS. 9-12.

Figure 3:
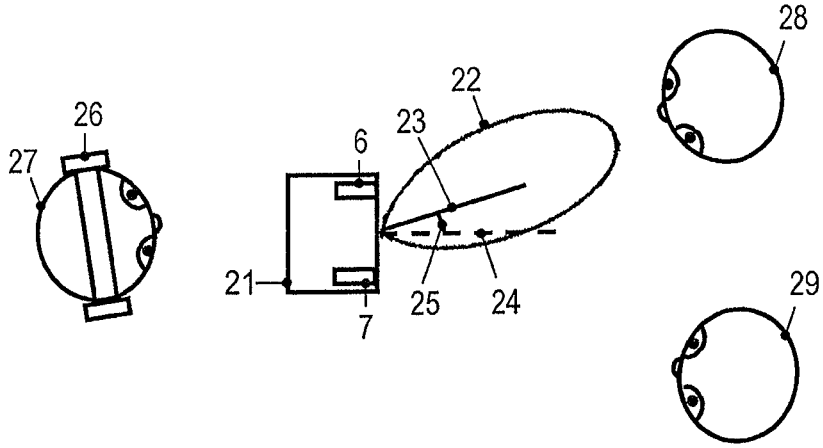
FIG. 3 and FIG. 4 are schematic top views illustrating an adjustment of angular orientation of a directivity pattern in a first direction.

FIG. 3 is a schematic top view illustrating an electronic device 21 according to an embodiment. The device 21 may be configured as explained with reference to FIG. 1 or FIG. 2. The device 21 includes at least two microphones 6, 7 and a sound processor for processing output signals from the at least two microphones. The two microphones 6, 7 are included in a microphone arrangement which has a directivity pattern with a main lobe 22. The main lobe is a sound capturing lobe indicative of the direction in which the microphone arrangement has high sensitivity. The microphone arrangement may define additional sound capturing lobes, which are omitted for clarity.

The device 21 may include additional components, such as an image sensor, for performing combined audio and video recording. The image sensor has an optical axis 24 which may generally be fixed relative to the housing of the device 21.

The device 21 is illustrated to be interposed between a user 27 and plural sound sources 28, 29. This is a characteristic situation when a user performs audio recording, possibly in combination with video recording, of third parties using a mobile communication device. The user has a headset 26. Components for sensing the orientation of the headset 26 relative to the device 21 or relative to a stationary frame of reference may be included in the headset 26 or in the device 21.

The sound capturing lobe 22 has a center line 23. The center line 23 has an orientation relative to the device 21, which may, for example, be defined by two angles relative to the optical axis 24. As illustrated in the top view of FIG. 3, the center line 23 of the sound capturing lobe 22 encloses an angle 25 relative to the optical axis 24. The sound capturing lobe 22 is thus directed towards the sound source 28.

The device 21 may be configured such that the direction of the sound capturing lobe 22 is slaved to the facial direction or to the eye gaze direction of the user 27. The user's facial direction or eye gaze direction is monitored and serves as an indicator for the user's focus of attention. The microphone arrangement of the device 21 may be controlled such that the center line 23 of the sound capturing lobe 22 points towards the user's eye gaze point, or such that the center line 23 of the sound capturing lobe 22 is aligned with the user's facial direction.

Figure 4:
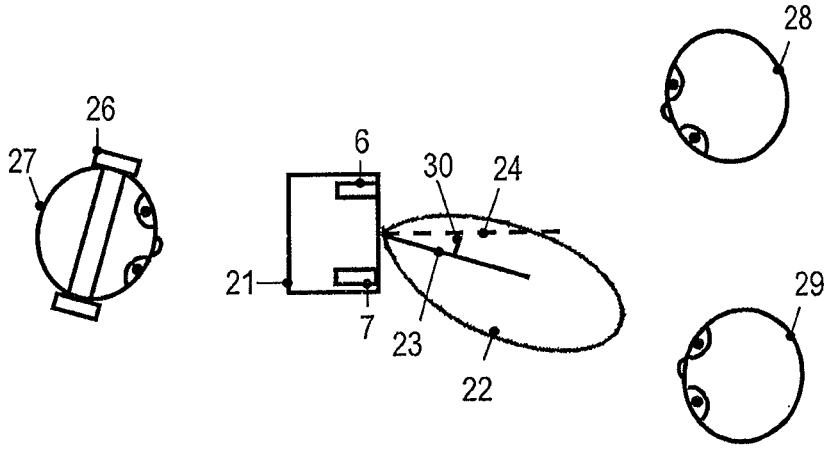

FIG. 4 is another schematic top view illustrating the electronic device 21 when the user 27 has turned his head so as to face towards sound source 29. The center line 23 of the sound capturing lobe 22 follows the change of the user's facial direction and is also directed towards sound source 29.

By adjusting the direction of a sound capturing lobe in accordance with sensor data which represent a user's head position or eye gaze direction, tasks such as adjusting the directional characteristics of the microphone arrangement may be performed automatically to follow the user's intention in an intuitive and smooth way. The gesture-or gaze-based control may be contact free in the sense that it does not require a user to interfere with the device 21 in a physical manner.

An automatic adjustment of the direction of a sound capturing lobe, as illustrated in FIG. 3 and FIG. 4, may not only be performed in response to a user's behavior. For illustration, by performing image analysis on video images captured by an image sensor of the device 21, the one of the persons 28, 29 who is speaking may be identified. The direction of the sound capturing lobe 22 may then be automatically adjusted based on which of the two sound sources 28, 29 is active.

Additional logics may be incorporated into the control. For illustration, the angular orientation of the center line of the sound capturing lobe does not need to always follow the determined target direction. Rather, when a lock trigger event is detected, the sound capturing lobe may remain directed towards a designated sound source, even when the user's gesture or eye gaze changes. This allows the user to change his/her gesture or eye gaze while the sound capturing lobe remains locked onto the designated sound source. The device may be configured such that the device locks onto a target direction if the user's gesture or eye gaze designates that target direction for at least a predetermined time. Subsequently, the user's gesture or eye gaze can still be monitored to detect a release condition, but the sound capturing lobe may no longer be slaved to the gesture or eye gaze direction in the lock condition. If a release event is detected, for example if the user's gesture or eye gaze is directed towards another direction for at least the predetermined time, the lock condition will be released. While described in the context of gesture-or eye gaze-based control, the lock mechanism may also be implemented when the target direction is set based on face recognition.

The device according to various embodiments may not only be configured to adjust a direction of the center line 23, which may correspond to the direction having highest sensitivity, of the sound capturing lobe 22, but may also be configured to adjust at least one aperture angle of the sound capturing lobe 22, as will be illustrated with reference to FIG. 5.

Figure 5:
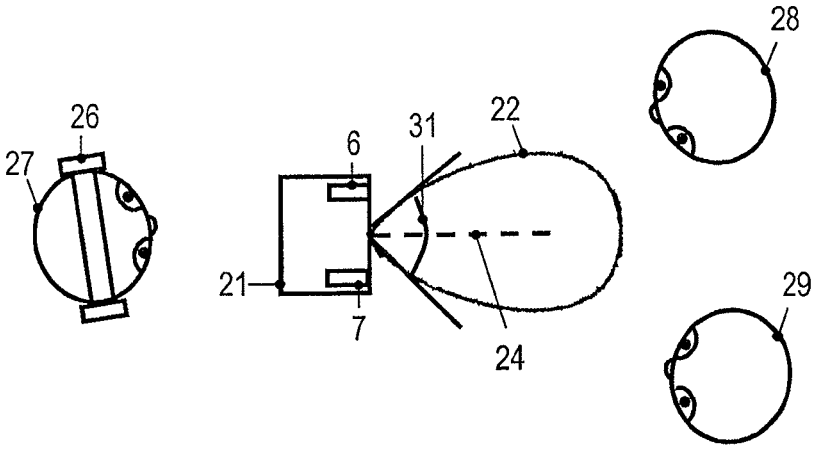
FIG. 5 is a schematic top view illustrating an adjustment of an aperture angle of a sound capturing lobe in a first direction.

FIG. 5 is another schematic top view illustrating the electronic device 21. The device 21 is shown in a state in which the controller has automatically adjusted an aperture angle 31 of the sound capturing lobe such that it covers both sound sources 28, 29. An appropriate value for the aperture angle may be determined automatically. For illustration, a face recognition algorithm may be performed on image data to identify portions of the image data representing the two sound sources 28, 29, and the aperture angle 31 may be set in accordance therewith. Additional data, such as a visual zoom setting of the image capturing system of the device 21, may also be taken into account when automatically determining the aperture angle 31.

The microphone arrangement of the device according to various embodiments may be configured such that the direction of a sound capturing lobe can be adjusted not only in one, but in two independent directions. Similarly, the microphone arrangement may further be configured so as to allow the aperture angles of the sound capturing lobe to be adjusted in two independent directions. For illustration, the microphone arrangement may include four microphones. Using audio beam forming techniques, the center line of the sound capturing lobe may be tilted in a first plane which is orthogonal to the plane defined by the four microphones (this plane being the drawing plane of FIG. 3 and FIG. 4), and in a second plane which is orthogonal to both the first plane and to the plane defined by the four microphones (this plane being orthogonal to the drawing plane of FIG. 3 and FIG. 4). Further, using audio beam forming techniques, an aperture angle of the sound capturing lobe as defined by the projection of the sound capturing lobe onto the first plane may be adjusted, and another aperture angle of the sound capturing lobe as defined by the projection of the sound capturing lobe onto the second plane may be adjusted.

Figure 6:
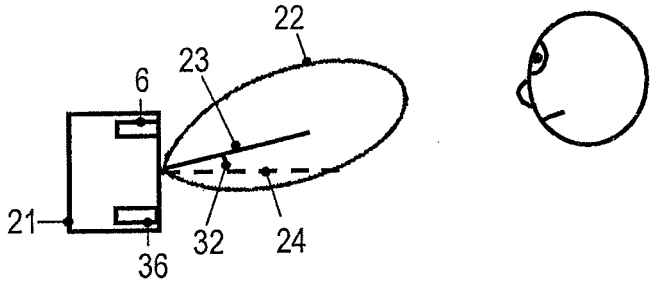
FIG. 6 is a schematic side view illustrating an adjustment of angular orientation of a directivity pattern in a second direction.

FIG. 6 is a schematic side view illustrating the electronic device 21. The microphone arrangement includes a pair of additional microphones, one of which is shown at 36 in FIG. 6. The controller of the device 21 may control the microphone arrangement so as to adjust the direction of the center line 23 of the sound capturing lobe 22 in another plane, which corresponds to a vertical plane. In other words, an angle 32 between the center line 23 of the sound capturing lobe 22 and the optical axis 24 of the device 22 may be adjusted, thereby tilting the sound capturing lobe 22 through a vertical plane. The orientation of the sound capturing lobe may be controlled based on sensor data indicative of a user's behavior, and/or based on image data which are analyzed to identify sound sources. While not shown in FIG. 6, not only the orientation of the center line 23, but also the aperture angle of the sound capturing lobe 22 in this second plane may be adjusted. Control over the sound capturing lobe in the second direction, as illustrated in FIG. 6, may be performed in addition to the control in a first direction, as illustrated in FIG. 3 through FIG. 5.

Figure 7:
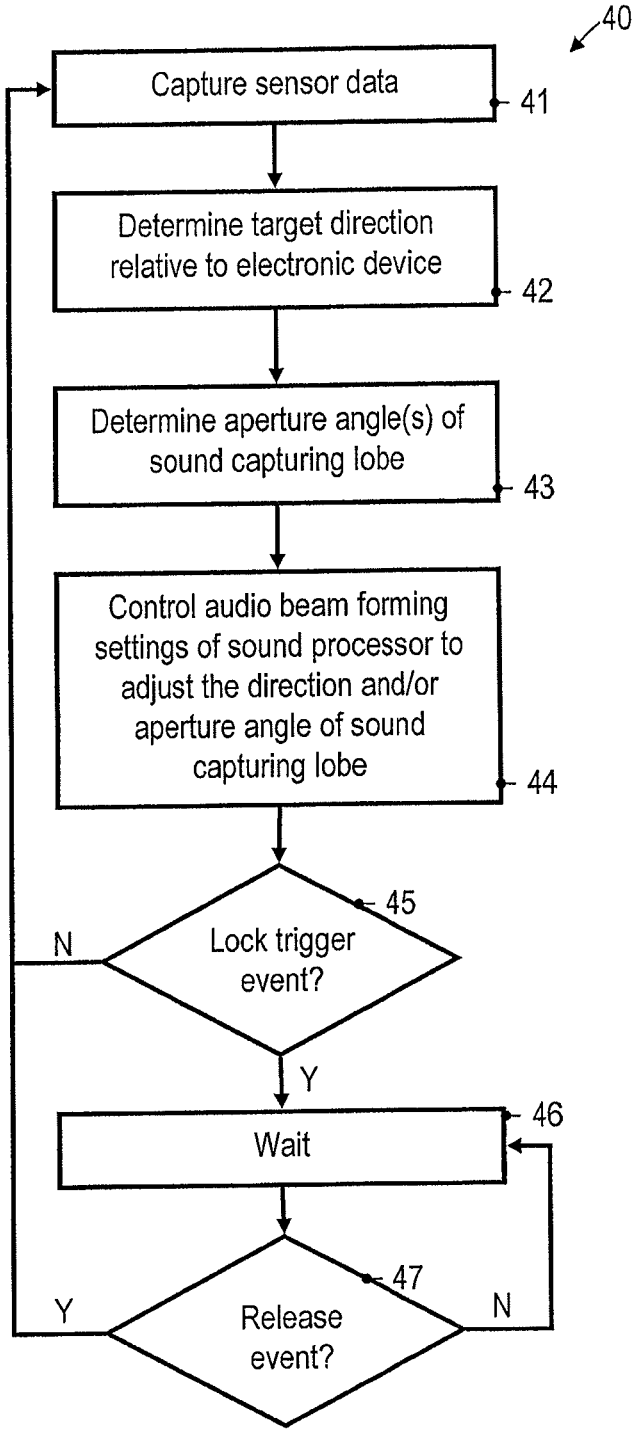
FIG. 7 is a flow diagram of a method of an embodiment.

FIG. 7 is a flow diagram representation of a method of an embodiment. The method is generally indicated at 40. The method may be performed by the electronic device, possibly in combination with an external device having a sensor for capturing the sensor data, as explained with reference to FIGS. 1-6.

At 41, sensor data are captured. The sensor data may have various formats, depending on the specific sensor used. The sensor data may include data which are indicative of a user's gesture or of a user's eye gaze direction. Alternatively or additionally, the sensor data may include image data representing one or several sound sources for which audio recording is to be performed.

At 42, a target direction is automatically determined in response to the captured sensor data. The target direction may define a desired direction of a center line of a sound capturing lobe. If the sensor data include data which are indicative of a user's gesture or of a user's eye gaze direction, the target direction may be determined in accordance with the gesture or eye gaze direction. If the sensor data include data representing one or several sound sources, the target direction may be determined by performing image recognition to identify image portions representing human faces, and by then selecting the target direction based on the directions of the face(s).

At 43, an aperture angle of the sound capturing lobe is determined. The aperture angle may be determined based on the sensor data and, optionally, based on a visual zoom setting associated with an image sensor of the device.

At 44, the target direction and the aperture angle are provided to the microphone arrangement for audio beam forming. The target direction and the aperture angle may, for example, be used by a sound processor of a microphone arrangement for audio beam forming, such that a sound capturing lobe, in particular the main lobe, of the microphone arrangement has its maximum sensitivity directed along the target direction. Further, the sound processing may be implemented such that the main lobe has the automatically determined aperture angle(s).

The sequence 41-44 of FIG. 7 may be repeated intermittently or continuously. Thereby, the sound capturing lobe can be made to follow a user's focus of attention and/or a sound source position as a function of time. Alternatively or additionally, a lock mechanism may be included in the method, as will be explained next.

At 45, a lock trigger event is monitored to determine whether the angular orientation of the sound capturing lobe is to be locked in its present direction. The lock trigger event may take any one of various forms. For illustration, the lock trigger event may be a dedicated user command. Alternatively, the lock trigger event may be the sensor data indicating a desired target direction for at least a predetermined time. For gesture-or eye gaze-based control, the lock trigger event may be detected if the user points or gazes into one direction for at least the predetermined time. For face-recognition based control, the lock trigger event may be detected if the active sound source, as determined based on image analysis, remains the same for at least the predetermined time.

If, at 45, the lock event is detected, the method returns to 41.

If, at 45, it is determined that the lock condition is fulfilled, the method may proceed to a wait state at 46. In the wait state, the sound capturing lobe may remain directed towards the designated target direction. If the orientation of the device which has the microphone arrangement can change relative to a frame of reference in which the sound sources are located, the direction of the sound capturing lobe relative to the device may be adjusted even in the wait state at 46 if the orientation of the device changes in the frame of reference in which the sound sources are located. Thereby, the sound source can remain directed towards a designated target, in a laboratory frame of reference, even if the device orientation changes.

At 47, a release event is monitored to determine whether the lock condition is to be released. The release event may take any one of various forms. For illustration, the release event may be a dedicated user command. Alternatively, the release event may be the sensor data indicating a new desired target direction for at least a predetermined time. For gesture- or eye gaze-based control, the release event may be detected if the user points or gazes into a new direction for at least the predetermined time. For image-recognition based control, the release event may be detected if there is a new active sound source which is determined to correspond to a speaking person for at least the predetermined time. Thereby, a hysteresis-type behavior may be introduced. This has the effect that the direction of the sound capturing lobe, which is generally slaved to the gesture, eye gaze, or an active sound source identified using face recognition, may become decoupled from the sensor data for a short time.

If, at 47, the release event is detected, the method returns to 41. Otherwise, the method may return to the wait state at 46.

Figure 8:
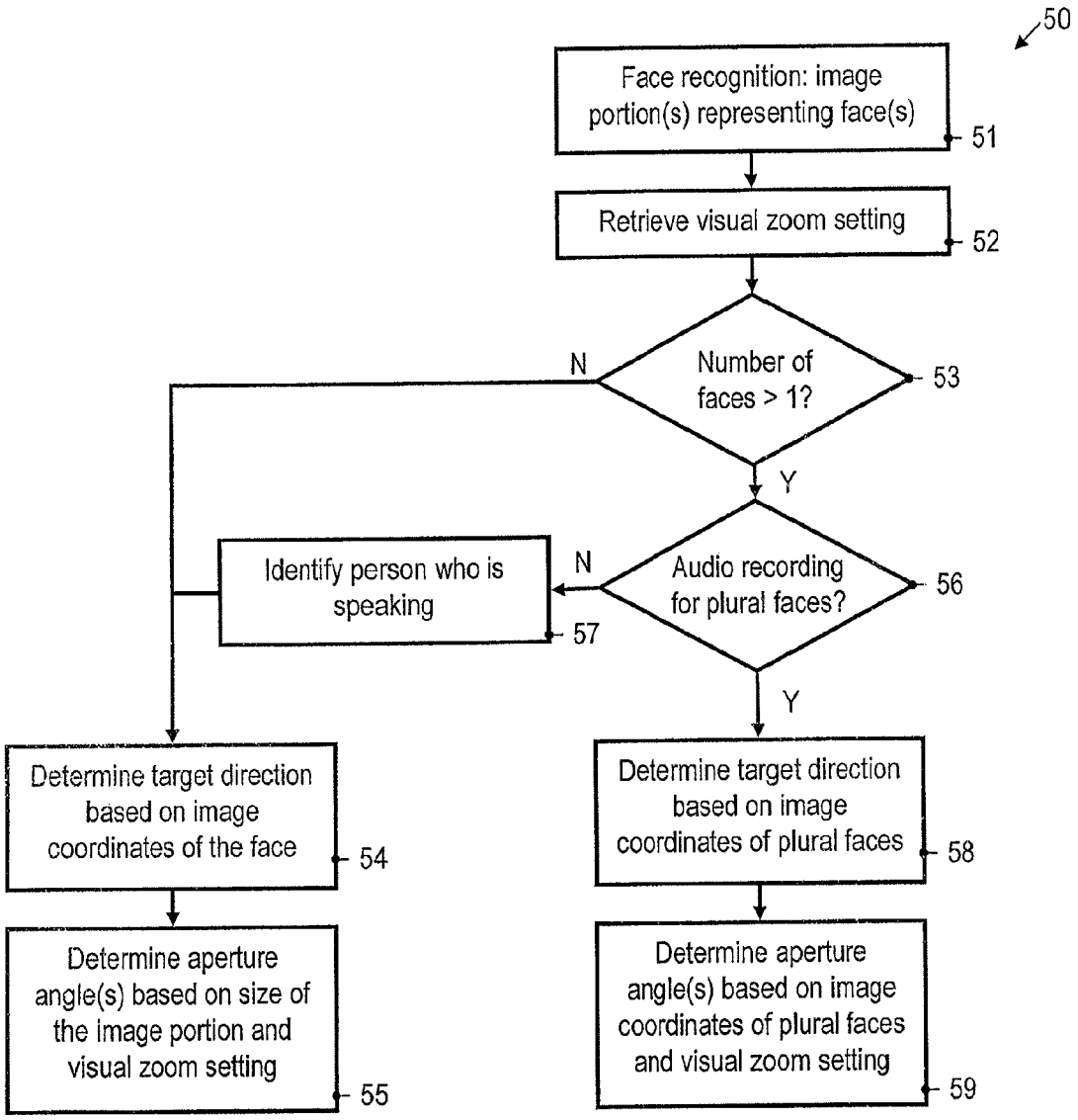
FIG. 8 is a flow diagram of a method of an embodiment.

FIG. 8 is a flow diagram representation illustrating acts which may be used to implement the determining the target direction and aperture angle(s) at 42 and 44 in FIG. 7 when the sensor data are image data representing sound sources. The sequence of acts is generally indicated at 50.

At 51, a face recognition is performed. Portions of the image data are identified which represent one or plural faces.

At 52, a visual zoom setting is retrieved which correspond to the image data. The visual zoom setting may correspond to a position of an optical zoom mechanism.

At 53, it is determined whether the number of faces identified in the image data is greater than one. If the image data include only one face, the method proceeds to 54.

At 54, a target direction is determined based on the image coordinates of the face.

At 55, an aperture angle of the sound capturing lobe is determined based on a size of the image portion representing the face and based on the visual zoom setting. By taking into account the visual zoom setting, the distance of the person from the device can be accounted for. For illustration, a person having a face that appears to occupy a large portion of the image data may still require only a narrow angled sound capturing lobe if the person is far away and has been zoomed in using the visual zoom setting. By contrast, a person that is closer to the device may require a sound capturing lobe having a greater aperture angle. Information on the distance may be determined using the visual zoom setting in combination with information on the size of the image portion representing the face.

If it is determined, at 53, that the image data represent more than one face, the method proceeds to 56. At 56, it is determined whether it is desired to perform audio recording simultaneously for plural sound sources. The determining at 56 may be made based on a pre-set user preference. If it is determined that audio recording is to be performed for one sound source at a time, the method proceeds to 57.

At 57, a person who is speaking may be identified among the plural image portions representing plural faces. Identifying the person who is speaking may be performed in various ways. For illustration, a short sequence of images recorded in a video sequence may be analyzed to identify the person who shows lip movements. After the person who is speaking has been identified, the method continues at 54 and 55 as described above. The target direction and aperture angle are determined based on the image portion which represents the person identified at 57.

If it is determined, at 56, that audio recording is to be performed for plural sound sources, the method proceeds to 58.

At 58, a target direction is determined based on the image coordinates of the plural faces identified at 51. The target direction does not need to coincide with the direction of any one of the faces, but may rather correspond to a direction intermediate between the different faces.

At 59, an aperture angle of the sound capturing lobe is determined based on the image coordinates of the plural faces and based on the visual zoom setting. The aperture angle is selected such that the plural faces are located within the sound capturing lobe. While illustrated as separate steps in FIG. 8, the determining of the target direction at 58 and of the aperture angle(s) at 59 may be combined to ensure that a consistent set of a target direction and aperture angle are identified. Again, a visual zoom setting may be taken into account when determining the aperture angle.

The number of direction coordinates determined at 54 or 58 and the number of aperture angles determined at 55 or 59, respectively, may be adjusted based on the number of microphones of the microphone arrangement. For illustration, if the microphone array has only two microphones, the sound capturing lobe can be adjusted in only one plane. It is then sufficient to determine one angle representing the direction of the sound capturing lobe, and one aperture angle. If the microphone array includes four microphones, the sound capturing lobe can be adjusted in two orthogonal directions. In this case, the target direction may be specified by a pair of angles, and two aperture angles may be determined to define the aperture of the sound capturing lobe.

The sequence of acts explained with reference to FIG. 8 will be illustrated further with reference to FIG. 9 through FIG. 12.

Figure 9:
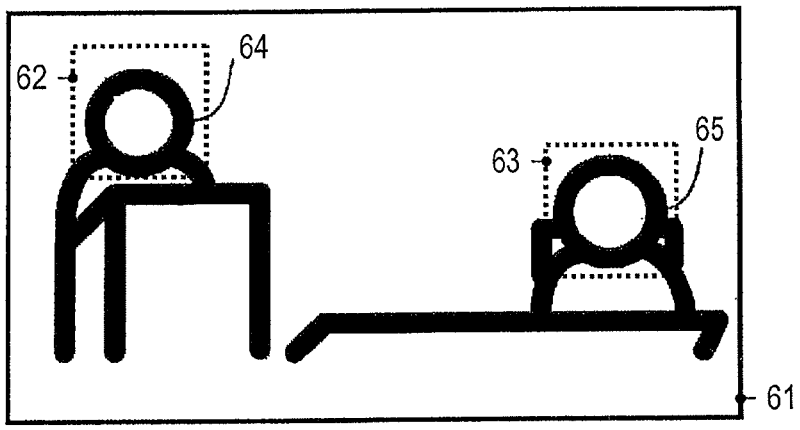
FIG. 9 is a schematic diagram showing illustrative image data.

FIG. 9 is a schematic representation illustrating image data 61. The image data 61 include a portion 62 representing a first face 64 and another portion 63 representing a second face 65. The faces 64, 65 are potential sound sources. Face recognition may be performed on the image data 61 to identify the portions 62 and 63 which represent human faces.

Figure 10:
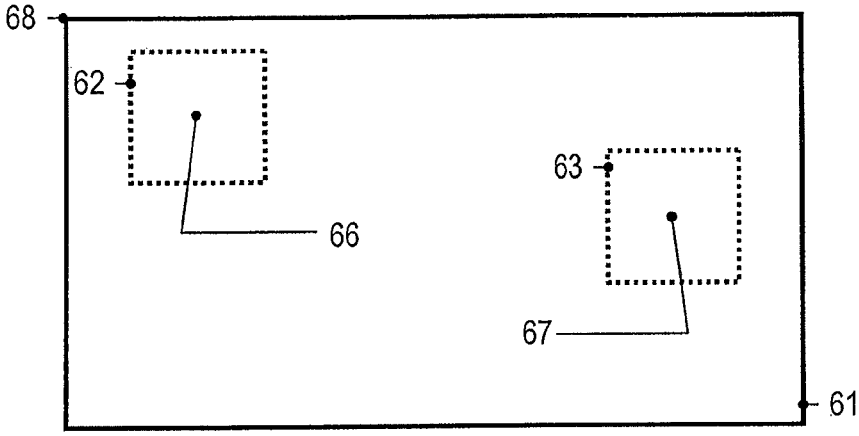
FIG. 10 is a schematic diagram illustrating segmentation of the image data of FIG. 9.

FIG. 10 shows the coordinate space of the image data 61 with the identified portions 62 and 63, with the origin 68 of the coordinate space being shown in a corner. Image coordinates 66 of the image portion 62 representing the first face may be determined relative to the origin 68. Image coordinates 67 of the image portion 63 representing the second face may be determined relative to the origin 68. The image coordinates may respectively be defined as coordinates of the center of the associated image portion.

Based on the image coordinates of the faces in the image data 61 and based on visual zoom settings, the direction and aperture angle(s) of a sound capturing lobe may be automatically set. The direction and aperture angle(s) may be determined so that the sound capturing lobe is selectively directed towards one of the two faces, or that the sensitivity of the microphone arrangement is above a given threshold for both faces. If the device has two microphones, one angle defining the direction of the sound capturing lobe and one aperture angle may be computed from the image coordinates of the faces and the visual zoom setting. If the device has more than two microphones, two angles defining the direction of the sound capturing lobe and two aperture angles may be computed from the image coordinates of the faces and the visual zoom setting.

Figure 11:
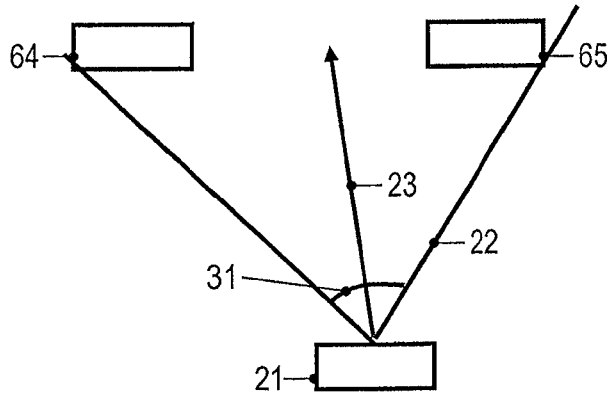
FIG. 11 is a schematic top view illustrating an adjustment of a direction and aperture angle of a sound capturing lobe in a first direction based on the image data of FIG. 9.

FIG. 11 is a schematic top view illustrating the sound capturing lobe 22 as it is automatically determined, in case the sound capturing lobe is to cover plural faces. The device 21 includes the microphone arrangement, as previously described. The center line 23 of the sound capturing lobe and the aperture angle 31 of the sound capturing lobe, projected onto a horizontal plane, are set such that the directional microphone arrangement has high sensitivity for the directions in which the two faces 64, 65 are located.

Figure 12:
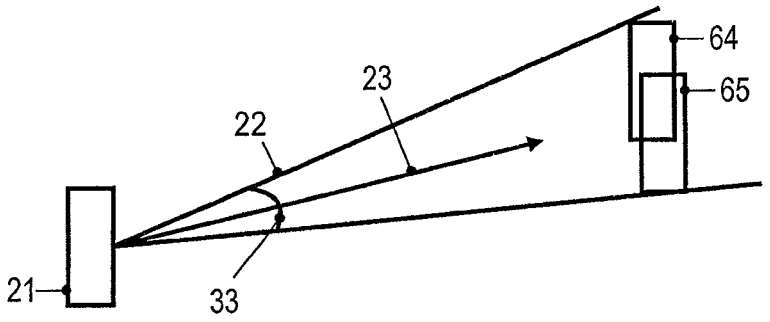
FIG. 12 is a schematic side view illustrating an adjustment of a direction and aperture angle of a sound capturing lobe in a second direction based on the image data of FIG. 9.

FIG. 12 is a schematic top view if the microphone arrangement allows the sound capturing beam to be adjusted in two distinct directions, such as both horizontally and vertically. FIG. 12 illustrates the resulting sound capturing lobe 22 if the sound capturing lobe is to cover plural faces. The center line 23 of the sound capturing lobe and the aperture angle 33 of the sound capturing lobe, projected onto a vertical plane, are set such that the directional microphone arrangement has high sensitivity for the directions in which the two faces 64, 65 are located.

If the device is configured such that the sound capturing lobe is to be focused onto one sound source at a time, the image portions 64, 65 in a series of time-sequential images may be analyzed to identify the person who is speaking, for example based on lip movement. The target direction and aperture angle(s) may then be set in dependence on the image coordinates of the respective face. A configuration as illustrated in FIG. 3 and FIG. 4 results, but with the direction of the sound capturing lobe being controlled by the results of image recognition rather than by a user's behavior. If the person who is speaking changes, the direction of the sound capturing lobe may automatically be adjusted accordingly.

While methods of controlling audio recording and electronic devices according to various embodiments have been described, various modifications may be implemented in further embodiments. For illustration rather than limitation, while exemplary implementations for sensors have been described, other or additional sensor componentry may be used. For illustration, rather than integrating sensor componentry for detecting a user's head orientation into a headset, sensor componentry for determining a head orientation may also be installed at a fixed location spaced from both the device which includes the microphone arrangement and from the user.

It is to be understood that the features of the various embodiments may be combined with each other. For illustration rather than limitation, a sensor monitoring a position of a user's body, hand, head or a user's eye gaze direction may be combined with an image sensor capturing image data representing potential sound sources. In the presence of plural sound sources, a decision regarding the target direction may be made not only based on the image data, but also taking into account the monitored user's behavior.

Examples for devices for audio recording which may be configured as described herein include, but are not limited to, a mobile phone, a cordless phone, a personal digital assistant (PDA), a camera and the like.

The invention claimed is:

1. A method of controlling audio recording using an electronic device, said electronic device comprising a microphone arrangement having a directivity pattern, said method comprising:

capturing sensor data using a sensor different from said microphone arrangement, said captured sensor data representing at least a portion of an area surrounding said electronic device;

automatically determining a target direction relative to said electronic device in response to said captured sensor data;

determining a visual zoom setting of said electronic device; and automatically controlling said microphone arrangement in response to said determined target direction and in response to said visual zoom setting to adjust an angular orientation of said directivity pattern relative to said electronic device, wherein an aperture angle of a sound capturing lobe of said microphone arrangement defines a width of the sound capturing lobe and is controlled in response to at least said visual zoom setting.

2. The method of claim 1, said directivity pattern of said microphone arrangement defining said sound capturing lobe, said sound capturing lobe having a center line, wherein said automatically controlling comprises adjusting a direction of said center line of said sound capturing lobe relative to said electronic device.

3. The method of claim 2, said direction of said center line of said sound capturing lobe being selectively adjusted in two orthogonal directions in response to said determined target direction.

4. The method of claim 2, said automatically controlling comprising adjusting both said aperture angle and a further aperture angle of said sound capturing lobe, said aperture angle and said further aperture angle defining widths of said sound capturing lobe in two perpendicular planes.

5. The method of claim 2, said sound capturing lobe being disposed on a first side relative to a plane defined by said microphone arrangement, and said portion of said area surrounding said electronic device represented by said sensor data being disposed on a second side relative to said plane, said first side and said second side being opposite to each other.

6. The method of claim 1, said sensor monitoring a portion of a user's body which is spaced from said electronic device to capture said sensor data.

7. The method of claim 6, said sensor data being processed to identify a gesture of said user, said angular orientation of said directivity pattern being adjusted in response to said identified gesture.

8. The method of claim 6, said sensor data being processed to identify an eye gaze direction of said user, said angular orientation of said directivity pattern being adjusted in response to said identified eye gaze direction.

9. The method of claim 6, said sensor comprising sensor components integrated into a headset worn by said user.

10. The method of claim 1, said sensor comprising an electronic image sensor, said captured sensor data comprising image data representing at least said portion of said area surrounding said electronic device, said automatically determining said target direction comprising processing said image data to identify at least one portion of said image data representing at least one human face.

11. The method of claim 10, said automatically identifying said target direction comprising determining whether said image data represent plural human faces;

selectively identifying, based on a result of said determining, plural portions of said image data representing said plural human faces;

selectively monitoring, based on a result of said determining, said identified plural portions of said image data as a function of time to identify a portion representing a person who is speaking; and selectively setting, based on a result of said determining, said target direction based on image coordinates of said identified portion representing a person who is speaking.

12. The method of claim 10, said automatically identifying said target direction comprising determining whether said image data represent plural human faces;

selectively identifying, based on a result of said determining, plural portions of said image data representing said plural human faces;

selectively setting, based on a result of said determining, said target direction based on image coordinates of said plural portions.

13. An electronic device, comprising:

a microphone arrangement having a directivity pattern;

a controller coupled to said microphone arrangement, said controller having an input to receive sensor data from a sensor different from said microphone arrangement, said sensor data representing at least a portion of an area surrounding said electronic device, said controller being configured to determine a visual zoom setting of an optical component of said electronic device, to automatically determine a target direction relative to said electronic device in response to said captured sensor data, to automatically control said microphone arrangement in response to said determined target direction and in response to said visual zoom setting to adjust an angular orientation of said directivity pattern relative to said electronic device, and to automatically control an aperture angle of a sound capturing lobe of said microphone arrangement in response to at least said visual zoom setting, said aperture angle defining a width of a sound capturing lobe of said microphone arrangement.

14. The electronic device of claim 13, said microphone arrangement comprising an array having a plurality of microphones and a sound processor coupled to receive output signals from said plurality of microphones, said controller being coupled to said sound processor to control audio beam forming settings in order to automatically adjust, in response to said determined target direction, a direction of said sound capturing lobe of said microphone arrangement relative to said electronic device.

15. The electronic device of claim 14, said controller being configured to control said microphone arrangement to selectively adjust an orientation of said sound capturing lobe in two orthogonal directions in response to said identified target direction.

16. The electronic device of claim 13, said controller being configured to process said sensor data to identify a user's gesture and/or user's eye gaze direction, and to determine said target direction based on said gesture and/or eye gaze direction.

17. The electronic device of claim 13, said sensor data comprising image data, said controller being configured to process said image data to identify at least one portion of said image data representing at least one human face and to automatically determine said target direction based on said at least one portion representing at least one human face.

18. The electronic device of claim 13, further comprising an image sensor having an optical axis, said controller being configured to automatically control said microphone arrangement to adjust an angular orientation of said directivity pattern relative to said optical axis.

19. The electronic device of claim 13, said electronic device being configured as a portable electronic communication device.

20. An electronic system, comprising the electronic device of claim 13, and at least one sensor component separate from said electronic device and in communication with said input of said controller to communicate at least a portion of said sensor data to said controller.

21. A portable electronic device, comprising a microphone arrangement having a directivity pattern;

a controller coupled to said microphone arrangement, said controller having an input to receive sensor data from a sensor different from said microphone arrangement, said sensor data representing at least a portion of an area surrounding said electronic device, said controller being configured to automatically control said microphone arrangement in response to said sensor data, to monitor a lock trigger event, to automatically control said microphone arrangement in response to said lock trigger event to lock a direction of a sound capturing lobe in a world reference frame.

22. The portable electronic device of claim 21, said controller being further configured to decouple an angular orientation of said directivity pattern from said sensor data in response to said lock trigger event, to monitor a release event, and to couple said angular orientation of said directivity pattern to said sensor data in response to said release event.

* * * * *